US005105228A

United States Patent [19]

Kato

[11] Patent Number: 5,105,228

[45] Date of Patent: Apr. 14, 1992

[54] FIXING UNIT HAVING SEPARATING CLAWS MOVABLE WITH THE OPENING AND CLOSING OF THE CLAW SHELL HOUSING

[75] Inventor: Tsutomu Kato, Yokohama, Japan

[73] Assignee: Kabushiki Kaisha Toshiba, Kawasaki, Japan

[21] Appl. No.: 487,443

[22] Filed: Mar. 2, 1990

[30] Foreign Application Priority Data

Mar. 7, 1989 [JP] Japan ..... 1-54606

[51] Int. Cl.[5] ..... G03G 15/20

[52] U.S. Cl. ..... 355/282; 355/200; 355/315

[58] Field of Search ..... 355/200, 282, 283, 296, 355/299, 315; 219/216; 271/900, 308

[56] References Cited

U.S. PATENT DOCUMENTS

| | | | |
|---|---|---|---|
| 4,475,804 | 10/1984 | Kanno et al. | 355/315 X |
| 4,806,970 | 2/1989 | Nakatomi et al. | 355/282 |
| 4,893,146 | 1/1990 | Tachibana et al. | 271/900 X |
| 4,965,640 | 10/1990 | Watarai et al. | 355/283 |

FOREIGN PATENT DOCUMENTS

| | | | |
|---|---|---|---|
| 0042573 | 3/1984 | Japan | 355/315 |
| 0105670 | 6/1984 | Japan | 355/299 |
| 0070466 | 4/1985 | Japan | 355/315 |
| 0104959 | 6/1985 | Japan | 355/200 |
| 0130779 | 7/1985 | Japan | 355/315 |
| 0242981 | 10/1987 | Japan | 355/315 |
| 0299982 | 12/1987 | Japan | 355/282 |
| 63-6588 | 1/1988 | Japan . | |
| 0082494 | 4/1988 | Japan | 355/282 |
| 0249872 | 10/1988 | Japan | 355/315 |
| 0013180 | 1/1989 | Japan | 355/282 |
| 0024285 | 1/1989 | Japan | 355/315 |
| 0032279 | 2/1989 | Japan | 355/282 |

*Primary Examiner*—A. T. Grimley
*Assistant Examiner*—Nestor R. Ramirez
*Attorney, Agent, or Firm*—Foley & Lardner

[57] ABSTRACT

The housing of an image forming apparatus is divided into upper and lower units, separated by a sheet transport path. The upper unit can be opened to expose the sheet transport path. Developer on a sheet is fixed by a heating roller and a pressing roller, both arranged in the sheet transport path. The sheet, which is likely to be wound around the heating roller, is reliably released from the heating roller by releasing claws. When the upper unit is opened, the releasing claws are separated from the heating roller by a claw contact/separation means. When the upper unit is closed, the releasing claws are automatically brought into contact with the heating roller.

29 Claims, 8 Drawing Sheets

FIXING UNIT HAVING SEPARATING CLAWS MOVABLE WITH THE OPENING AND CLOSING OF THE CLAW SHELL HOUSING

BACKGROUND OF THE INVENTION

1. Field of the Invention

The present invention relates to an image forming apparatus, such as an electronic copying apparatus and a laser printer, and more particularly to an image forming apparatus which has a fixing unit for fixing a developer (e.g., powdered toner) transferred onto a sheet.

2. Description of the Related Art

In recent years, an image forming apparatus (e.g., an electronic copying apparatus and a laser printer) has come to employ the so-called clam shell structure, for easy maintenance and for easy removal of sheets causing an abnormal transfer state. In the clam shell structure, the housing is divided into first and second units (i.e., upper and lower units), with the boundary therebetween defined by a sheet transport path formed inside the apparatus, and wherein the first unit can be opened in a direction away from the second unit.

The image forming apparatus comprises a fixing means for fixing a developer image to a sheet. Normally, the fixing means is of a heating roller type. It includes a pair of fixing rollers (namely, a heating roller and a pressing roller) which are in rolling contact with each other, and a releasing claw which is used for releasing a sheet from the fixing rollers, to prevent the sheet from being wound around the fixing rollers.

Published Unexamined Japanese Patent Application (PUJPA) No. 63-6588 discloses an example of a conventional image forming apparatus which is the clam shell type and which employs a fixing means of the heating roller type. As may be understood from the example in the reference, the releasing claw remains engaged with the fixing rollers even after the first unit is opened or separated from the second unit.

In the conventional image forming apparatus, the releasing claw remains engaged with the fixing rollers even after the first unit is opened, as mentioned above. If the releasing claw is touched by something and is thus subject to an external force, an impact is applied between the releasing claw and the fixing rollers. In such a case, it is likely that the tip end of the releasing claw will be broken or the surfaces of the fixing rollers will be scratched, so that a satisfactory fixing operation or a reliable releasing operation cannot be performed thereafter.

SUMMARY OF THE INVENTION

Accordingly, an object of the present invention is to provide an image forming apparatus, in which the releasing claw is separated from the fixing rollers when the first unit is opened and does not touch the fixing rollers even if it is subject to an external force, to thereby prevent the tip end of the releasing claw from being broken or prevent the surfaces of the fixing rollers from being scratched, and which ensures reliable fixing and releasing operations for a long time.

To achieve this object, the present invention provides an apparatus for developing an image on an image recording medium which comprises:

fixing means for fixing the developed image to the recording medium, said fixing means including first and second fixing rollers which are in rolling contact with each other, and a releasing claw for releasing the sheet from the fixing rollers;

a housing including first and second units which can be opened or closed with reference to each other, said fixing means being received in said housing; and releasing claw contact/separation means for separating the releasing claw from the fixing rollers i association with the opening operation of the first unit, and for bringing the releasing claw into contact with the fixing rollers in association with the closing operation of the first unit, said releasing claw contact/separation means having at least two rotation-permitting supports.

In this image forming apparatus, the releasing claw is separated from the fixing rollers when the first unit is opened. Therefore, the releasing claw does not touch the fixing rollers even if it is subject to an external force. Since no impact is applied between the releasing claw and the fixing rollers, as in the case where the releasing claw remains engaged with the fixing rollers, the tip end of the releasing claw is prevented from being broken or the surfaces of the fixing rollers are prevented from being scratched. In addition, the releasing claw never fails to be set in the apparatus since it is automatically brought into contact with the fixing rollers.

The present invention further provides an apparatus for developing an image on an image recording medium, which comprises:

fixing means, having a transport path, for fixing the developed image to the image recording medium conveyed along the transport path, the fixing means including first and second fixing rollers which are in rolling contact with each other, the transport path being defined between the first and second fixing rollers, and a releasing claw for releasing the recording medium from the fixing rollers;

a housing for receiving said fixing means, which is divided into first and second units, with the boundary therebetween defined by the transport path, and which can be opened or closed with reference to each other;

a support lever for supporting the second fixing roller of the fixing means, with the second fixing roller being constantly urged toward the first fixing roller, and for shifting the second fixing roller with reference to the first fixing roller such that the second fixing roller contacts or separates from the first fixing roller in association with the closing and opening of the first unit; and releasing claw contact/separation means for separating the releasing claw from the fixing rollers in association with the opening of the first unit, and for bringing the releasing claw into contact with the fixing rollers in association with the closing of the first unit.

In this second image forming apparatus, the releasing claw is separated from the fixing rollers when the first unit is opened. Therefore, the releasing claw does not touch the fixing rollers even if it is subject to with external force. Since no impact is applied between the releasing claw and the fixing rollers, as in the case where the releasing claw remains engaged with the fixing rollers, the tip end of the releasing claw is prevented from being broken or the surfaces of the fixing rollers are prevented from being scratched. In addition, the releasing claw never fails to be set in the apparatus since it is automatically brought into contact with the fixing rollers.

In the second image forming apparatus, moreover, the support lever shifts the second fixing roller with reference to the first fixing roller such that the second fixing roller contacts or separates from the first fixing roller in association with the closing or opening operation of the first unit, and the releasing claw is separated from the first fixing roller in association with the shifting movement of the support lever. Therefore, the second fixing roller contacts or separates from the first fixing roller when the releasing claw contacts or separates from the fixing rollers. With this construction, a gap is defined between the first and second fixing rollers when the first unit is opened. Therefore, the recording medium (e.g., a sheet of paper, a sheet of plastics, or the like) can be easily removed from the transport path if it causes an abnormal transfer state and stays in the sheet transfer path.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The first embodiment of the present invention will now be described, with reference to FIGS. 1 through 6.

Figure 1:
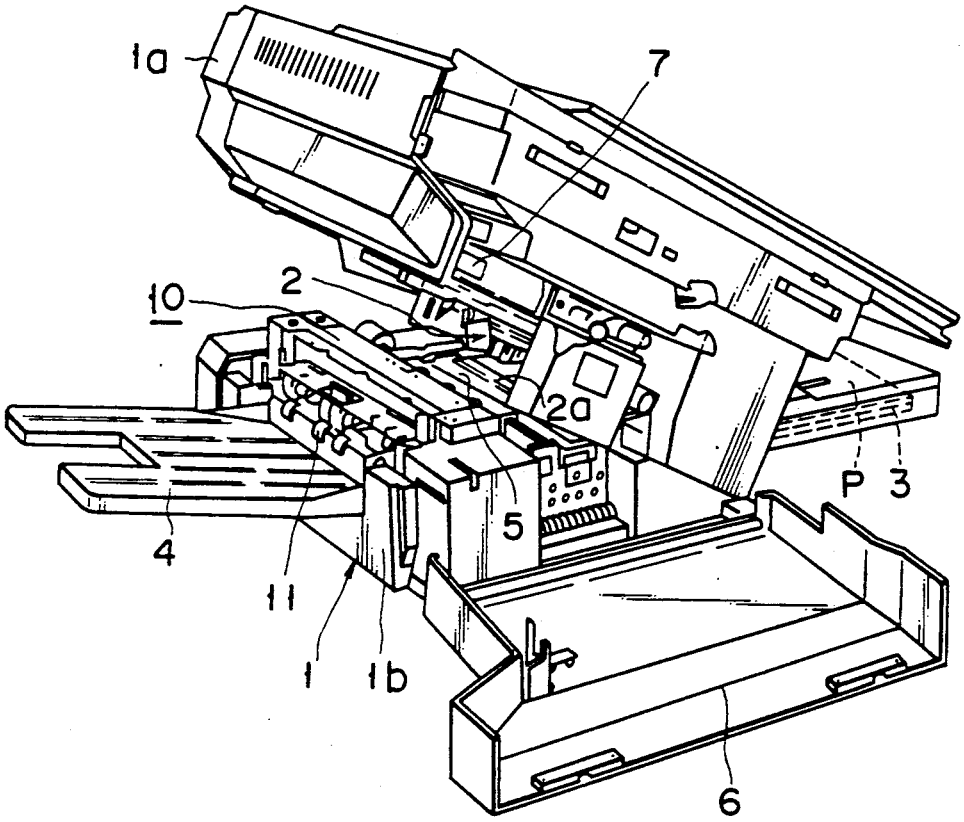
FIG. 1 is a perspective view of an electronic copying apparatus according to one embodiment of the invention, which shows a state where the upper unit of the electronic copying apparatus is open.

FIG. 1 illustrates the entire construction of an electronic copying apparatus (i.e., an image forming apparatus) whose upper unit is open. A photosensitive drum (i.e., an image supporting body) and an image forming device 2 (which is not shown in detail) are arranged inside the housing 1 of the apparatus. The image forming device 2 is located around the photosensitive drum and includes: an image forming device for forming an electrostatic latent image on the photosensitive drum; a developing device for developing the electrostatic latent image on the photosensitive drum with a developing powder or toner particles; a transfer device for transferring the developed image from the photosensitive drum to a sheet or paper P; a releasing device; a cleaning device for releasing the paper P from the photosensitive drum; an electric discharge device for discharging the photosensitive drum, etc.

A sheet supply cassette 3 from which the paper P is supplied and a sheet discharge tray 4 to which the image transferred papers P are discharged and stacked, are arranged on the right and left sides of the housing 1, respectively.

Inside the housing 1, a sheet transfer path 5 is defined. Along this sheet transfer path 5, the sheet P (which is exemplified by a sheet of paper, a sheet of plastics, or the like, and on which an image is formed with toner T) taken out of the sheet supply cassette 3 is guided to the sheet discharge tray 4 via a image transfer section 2*a*, located between the photo-sensitive drum and the transfer device. When the sheet P passes through the image transfer section 2*a*, toner T (FIG. 2) is transferred onto the sheet P, to thereby form a developed image.

The housing 1 is divided into an upper unit 1*a* (i.e., a first unit) and a lower unit 1*b* (i.e., a second unit), with the boundary therebetween defined by the sheet transport path. As is shown in FIG. 1, the upper unit 1*a* can be swung or opened, with its left side raised, by opening a front cover 6 and operating an upper unit opening/-closing lever 7. When the upper unit 1*a* is open, the sheet transport path 5 is kept exposed.

A fixing unit 10 is located downstream of the sheet transport path 5. When a sheet P passes through the fixing unit 10, the toner T, with which a developer image is formed, is melted and fixed to the sheet P.

Figure 2:
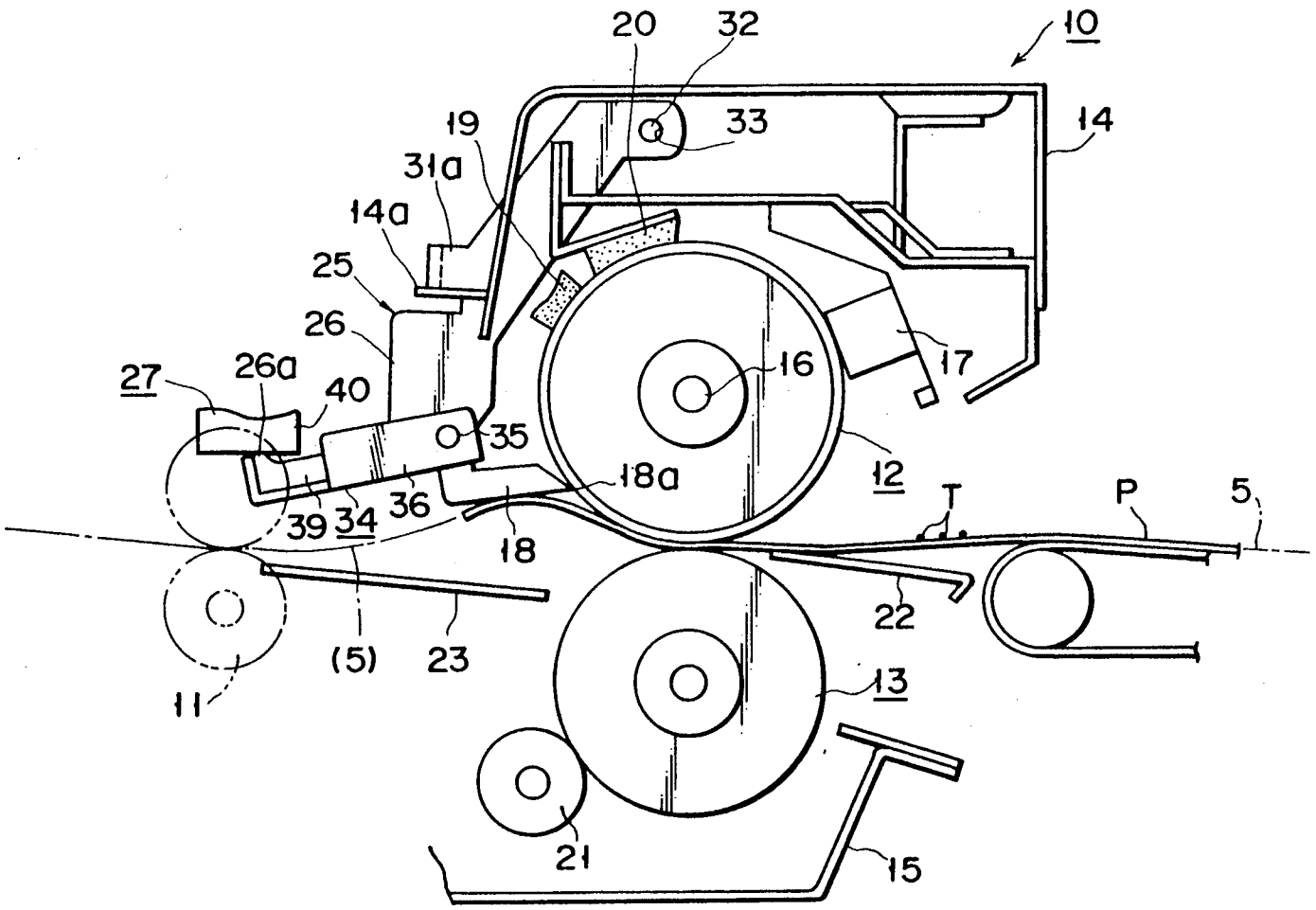
FIG. 2 is a sectional view of a fixing unit shown in FIG. 1.

As is shown in FIG. 2, the fixing unit 10 is made up of a heating roller 12 (i.e., a first fixing roller) located above the sheet transport path 5, and a pressing roller 13 (i.e., a second fixing roller) located under the sheet transport path 5 and pressed against the heating roller 12 by a spring member (not shown). These two rollers are surrounded by upper and lower covers 14 and 15, respectively.

When the sheet P passes through the region between the heating and pressing rollers 12 and 13, the toner T on the paper P is melted and fixed. After the toner T is fixed, the sheet P passes through the region between a pair of sheet discharge rollers 11 (i.e., a sheet discharge device) and is guided onto the sheet discharge tray 4.

The heating roller 12 is made up of a cylindrical core member formed of aluminum, Teflon-based resin coated on the surface of the core member, and a heating lamp 16 located inside the core member.

The temperature at the surface of the heating roller 12 is constantly detected by a thermistor 17. A detection signal of this thermistor is supplied to a control circuit (not shown), by which the heating lamp 16 is automatically turned on or off in such a manner that the surface of the heating roller 12 is maintained at a temperature which enables a developer image T to be reliably melted and fixed to the sheet P.

A plurality of sheet-releasing claws 18 (six claws in the case of this embodiment) are located in the vicinity of the heating roller 12. These releasing claws 18 separate and release the sheet P from the heating roller 12, thereby preventing the sheet P from being wound around the heating roller 12.

First and second cleaning members 19 and 20 are in contact with the heating roller 12, so as to clear the heating roller 12 of toner T which may be transferred thereto from the sheet P at the time of the fixing operation. The first and second cleaning members 19 and 20 are formed of elastic resin, such as felt. They scrape the toner T off the heating roller 12, to thereby prevent sheets from being stained with the toner T.

The pressing roller 13 is formed of silicone rubber. A silicone oil roller 21 is in rolling contact with the surface of the pressing roller 13. The silicone oil roller supplies silicone oil (which serves as a parting agent) to the surface of the pressing roller 13, so that a film of silicone oil is formed around the circumference of the heating roller 12. Due to this silicone oil film, the sheet P can be easily separated from the heating roller 12.

An inlet guide plate 22 and an outlet guide plate 23 are arranged in the vicinity of the pressing roller 13. The inlet guide plate 2 guides the leading end of the sheet P to the contact section between the heating roller 12 and the pressing roller 13, while the outlet guide plate 23 guides the leading end of the sheet P to the paired sheet discharge rollers 11 when the sheet P is separated from the circumference of the heating roller 12.

The sheet-releasing claws 18 are moved by a claw contact/separation device 25 in association with the swinging motion of the upper unit 1*a* of the housing 1. More specifically, the tip ends of the claws 18 are separated from the heating roller 12 when the upper unit 1*a* is opened, and are brought into contact with the heating roller 12 when the upper unit la is closed.

Roughly speaking, the claw contact/separation device 25 is made up of: a claw support mechanism 26 for movably supporting the claws 18; and a pushing device 27 for allowing the claws 18 to contact or separate from the heating rollers 12 by utilizing the pressure acting on the force-receiving portions 26*a* of the claw support mechanism 26.

Figure 3:
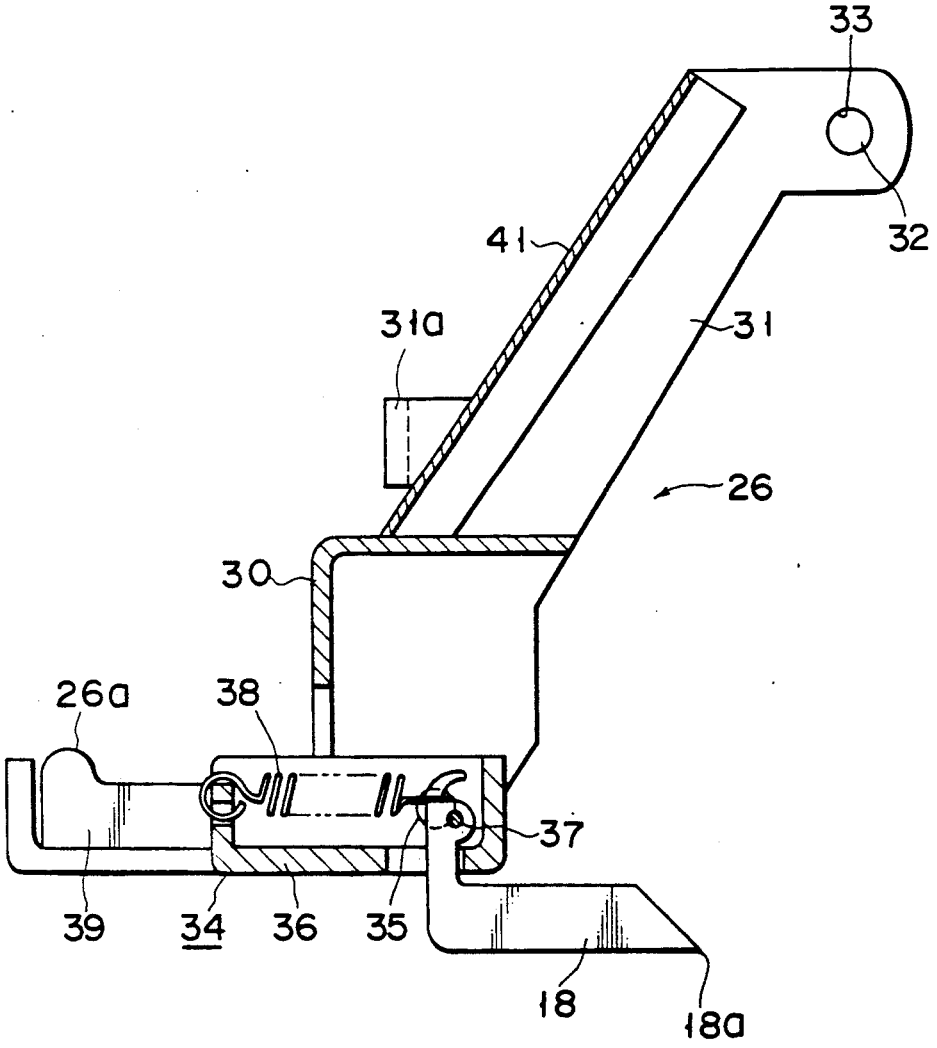
FIG. 3 is a sectional view of the claw support mechanism of the fixing unit shown in FIG. 2.
Figure 4:
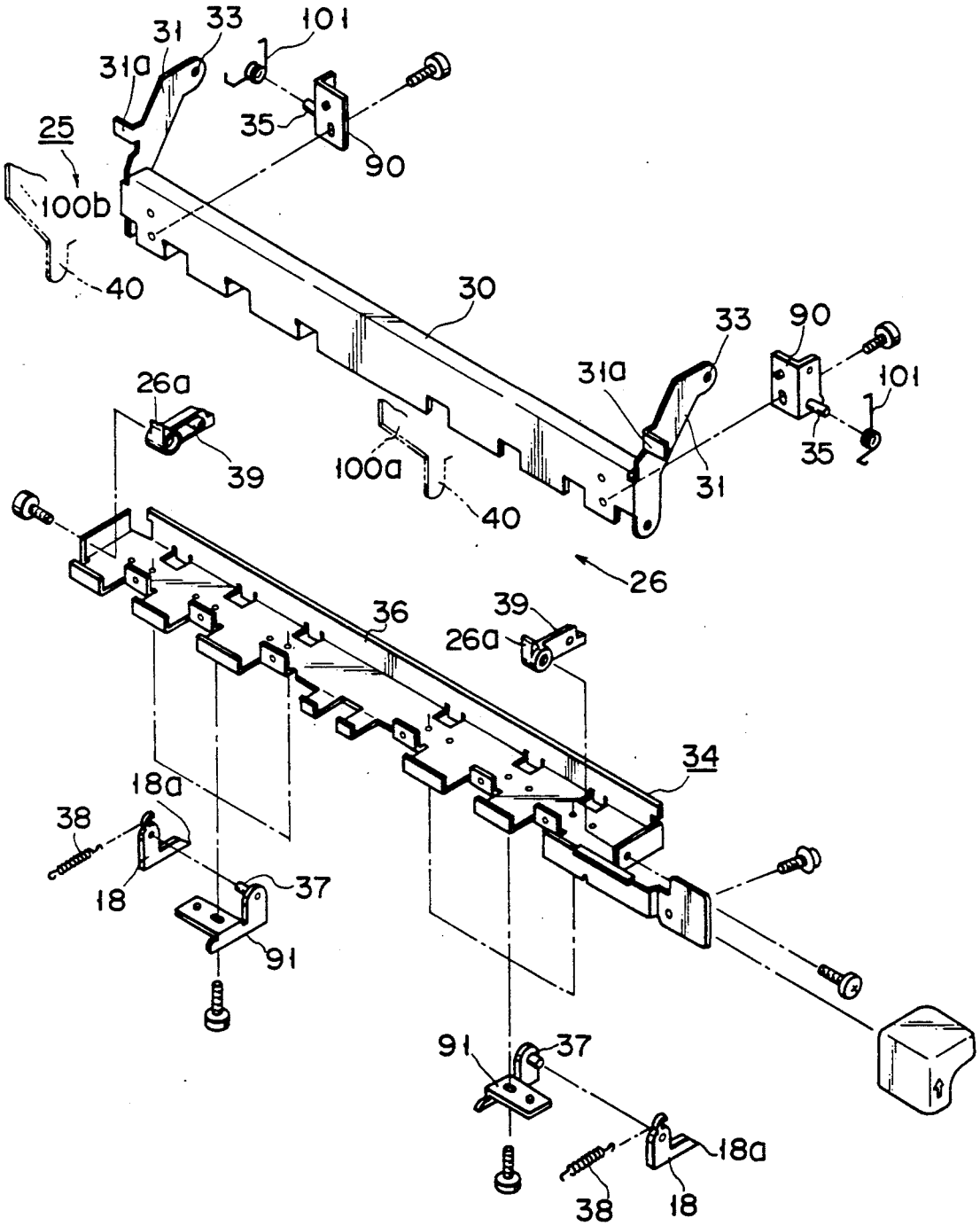
FIG. 4 is an exploded perspective view of the claw support mechanism shown in FIGS. 2 and 3.

The claw support mechanism 26 has such a construction as is shown in FIGS. 3 and 4. Referring to FIGS. 3 and 4, a pair of support arms 31 are attached to the respective ends of an arm coupling member 30. Each support arm 31 has a coupling hole 33 at its upper end, and a shaft 32 (which serves as a first rotation-permitting support) is fitted in the coupling hole 33 of each support arms 31. Stopper 31*a* is projected from the substantially vertical center of each support arm 31. The stopper 31*a* contacts the upper surface of a support piece 14*a* (FIG. 2), whereby the support arms 31 are positioned. The support piece 14*a* is formed by cutting and raising part of the upper cover 14.

A claw-holding unit 34 is rotatably provided on the lower side of the arm coupling member 30.

The claw-holding unit 34 includes a base member 36. The ends of this base member 36 are rotatably supported by shafts 35 (which serve as a second rotation-permitting support). These shafts 35 are projected from brackets 90 which are secured to the arm coupling member 30 by device of screws. The claw-holding unit 34 also includes sheet-releasing claws 18 arranged in the lengthwise direction of the base member 36 at predetermined intervals.

The sheet-releasing claws 18 are rotatably supported by shafts 37. These shafts are projected from brackets 91 which are secured to the base member 36 by brackets 91. The sheet-releasing claws 18 are constantly urged by spring members 38, in such a manner as to rotate in a predetermined direction (i.e., the counterclockwise direction, as viewed in FIG. 3), with the shafts 37 as a center of rotation.

Blocks 39 formed of synthetic resin are provided at respective end portions of the upper face of the base member 36. The synthetic resin blocks 39 constitute the force-receiving portions 26*a* mentioned above.

Pushing members 40 (which constitute the pushing device 27 mentioned above) are projected from the front and rear frames 100*a* and 100*b* of the upper unit 1*a* of the housing 1, respectively. The pushing members 40 are located at the positions corresponding to those of the synthetic resin blocks 39. When the upper unit 1*a* is closed, the pushing members 40 push down the synthetic resin blocks 39, as is shown in FIG. 2.

The region in which the heating roller 12 is arranged is surrounded by a heat insulation cover 14 extending between the support arms 31 attached to the arm coupling members 30. The cover 14 serves both to prevent the user's hand or fingers from being carelessly extended into the region and to prevent the heat generated in the region from escaping to the outside.

Next, a description will be given as to how the claw support mechanism 26 is coupled to the apparatus. As is shown in FIG. 2, the upper ends of the support arms 31 are attached to the fixing unit 10 by means of shafts 32 (i.e., the first rotation-permitting support). The support arms 31 are applied, due to their own weight, with a force which urges them to rotate counterclockwise with the shafts 32 as a center of rotation. Therefore, the stoppers 31*a* of the support arms 31 contact the upper surfaces of the support pieces 14*a* of the upper cover 14. As a result, the shafts 35 (i.e., the second rotation-permitting support) are positioned. The claw-holding unit 34, which is rotatable with the shafts 35 as a center of rotation, is therefore positioned with reference to the heating roller 12.

Figure 5:
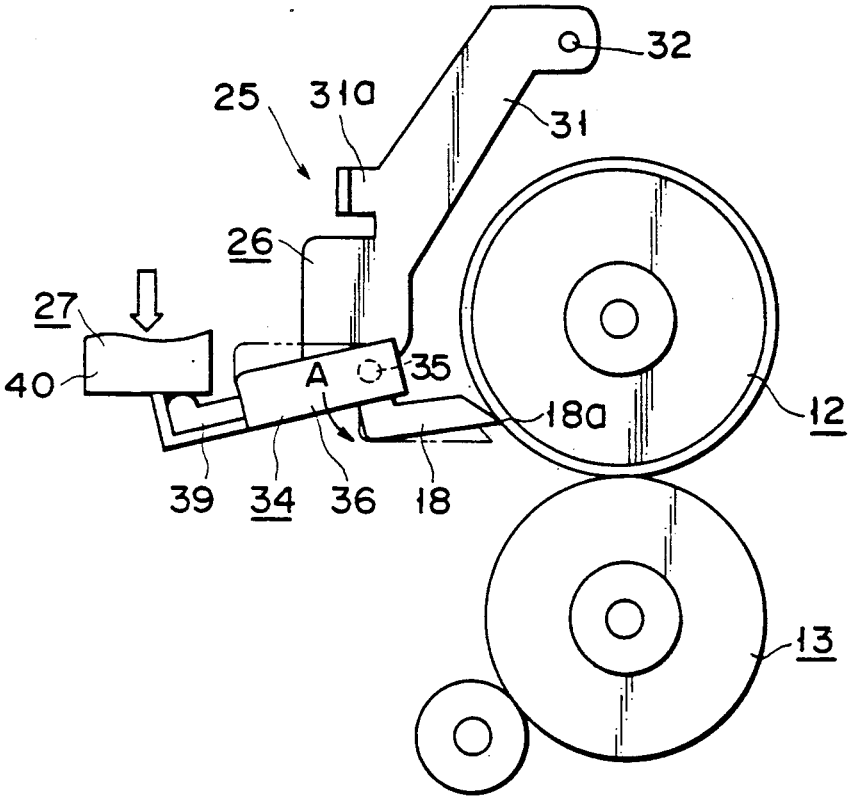
FIG. 5 is a view schematically illustrating how the releasing claw contacts the fixing rollers when the upper unit is closed in the apparatus shown in FIG. 1.

When the upper unit 1*a* is closed, the pushing members 40 (i.e., the pushing device 27) projected from the upper unit 1*a* push down the synthetic resin blocks 39 of the claw-holding unit 34, as is shown in FIGS. 2 and 5. As a result, the claw-holding unit 34 is rotated in the counterclockwise direction (i.e., the direction indicated by arrow A in FIG. 5) against the urging force of torsion springs 101, with the shafts 35 as a center of rotation. With the rotation of the claw-holding unit 34, the tip ends 18*a* of the sheet-releasing claws 18 are brought into contact with the surface of the heating roller 12. Since the releasing claws 18 are urged toward the surface of the heating roller 12 by the spring members 38, their ends can reliably contact the surface of the heating roller 12 with a predetermined pressure.

Due to these sheet-releasing claws 18, a sheet P can be reliably separated from the perimeter of the heating roller 12, as is shown in FIG. 2.

Figure 6:
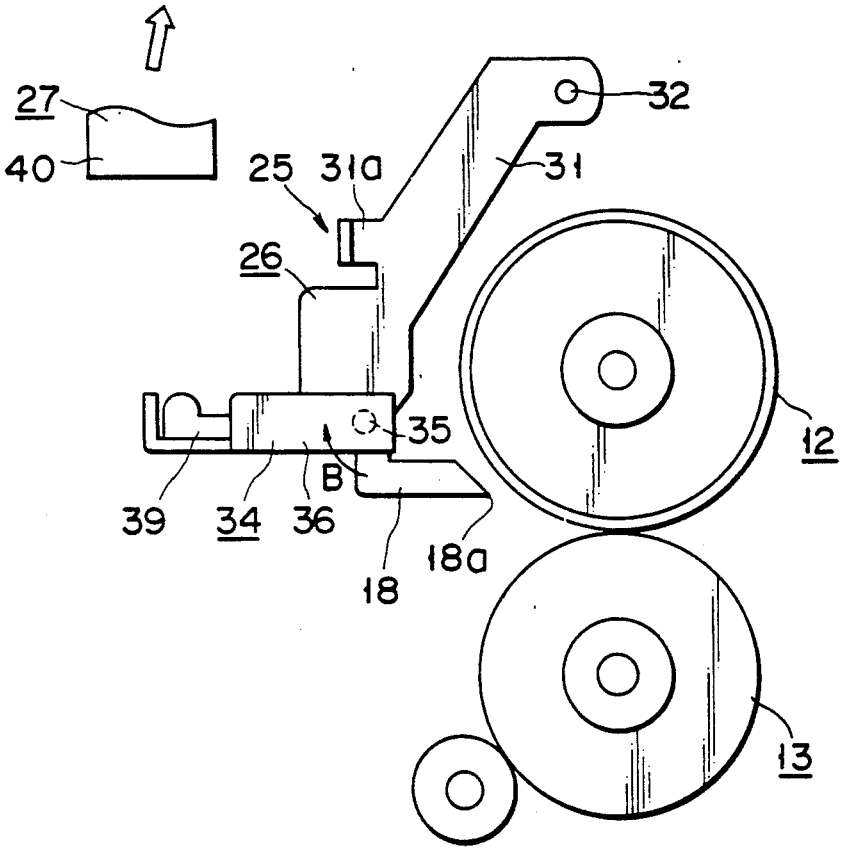
FIG. 6 is a view schematically illustrating how the releasing claw is separated from the fixing rollers when the upper unit is opened in the apparatus shown in FIG. 1.

When the upper unit la is opened, the pushing members 40 projected from the upper unit la are separated from the synthetic resin blocks 39 of the claw-holding unit 34, as is shown in FIG. 6. As a result, the claw-holding unit 34 is urged by the urging force of the torsion springs 101, and is therefore rotated in the clockwise direction (i.e., the direction indicated by arrow B in FIG. 6), with the shafts 35 as a center of rotation. Accordingly, the tip ends 18*a* of the sheet-releasing claws 18 are separated from the surface of the heating roller 12.

As stated above, the sheet-releasing claws 18 are separated from the heating roller 18 when the upper unit 1*a* is opened. Since the upper unit 1*a* is kept open during the maintenance of the apparatus or during the operation of removing the jamming of sheets, the sheet-releasing claws 18 are prevented from strongly abutting the heating roller 12, even if they are touched by the user and are thus applied with an external force. Therefore, the tip ends 18*a* of the releasing claws 18 are prevented from being broken, and the surface of the heating roller 12 is prevented from being scratched.

Moreover, the releasing claws 18 never fails to be set in the apparatus since they are automatically brought into contact with the surface of the heating roller 12 when the upper unit la is closed.

It should be noted that the claw support mechanism 26 of the claw contact/separation device 25 has shafts 32 and 35, which serve as the first and second rotation-permitting supports, respectively. With this construction, the claw support mechanism 26 is greatly displaced outwardly when rotated. Therefore, the releasing claws can be easily replaced with new ones, if they are broken or damaged.

The second embodiment of the present invention will now be described, with reference to FIGS. 7 and 8. In the descriptions below, similar portions or components to those of the first embodiment will be represented by the same reference numerals as used in FIGS. 1–6, and a detailed explanation of them will be omitted.

In the apparatus of the second embodiment, support lever 50 supports the pressing roller 13 such that the pressing roller contacts or separates from the first fixing roller, and a releasing claw contact/separation device 25' moves the sheet-releasing claws 18 with reference to the heating roller 12 by utilization of the rotation of the support levers 50. The releasing claw contact/separation device 25' comprises a claw support mechanism 26' for movably supporting the releasing claws 18, and a pushing mechanism 51 for moving the releasing claws 18 with reference to the heating roller 12 by utilization of the force applied to a force-receiving portion 26*a'* (which is the lower surface of the stopper portion 31*a'* of the claw support mechanism 26').

The claw support mechanism 26' includes a pair of support arms 31' (only one of which is shown), and a claw holding unit 34' fixed to the lower ends of the support arms 31'. The claw support mechanism 26' is rotatable with shafts 32 as a center of rotation.

The claw holding unit 34' is made up of a base member 36 fixed to the support arms 31', and sheet-releasing claws 18 which are arranged on the base member 36' at predetermined intervals, as in the first embodiment.

The support arms 31' have stopper portions 31*a'*, and the support levers 50 for supporting the pressing roller 13 have pins 52 at upper end portions thereof. The support arms 31' are positioned, with their stopper portions 31*a'* set in contact with the pins 52.

The upper end portions 50*a* of the support levers 50 are pushed by pushing members 40' projected from the upper unit 1*a*. Therefore, the support levers 50 are rotated with a support shaft 53 as a center of rotation, when the upper unit 1*a* is opened or closed.

Figure 7:
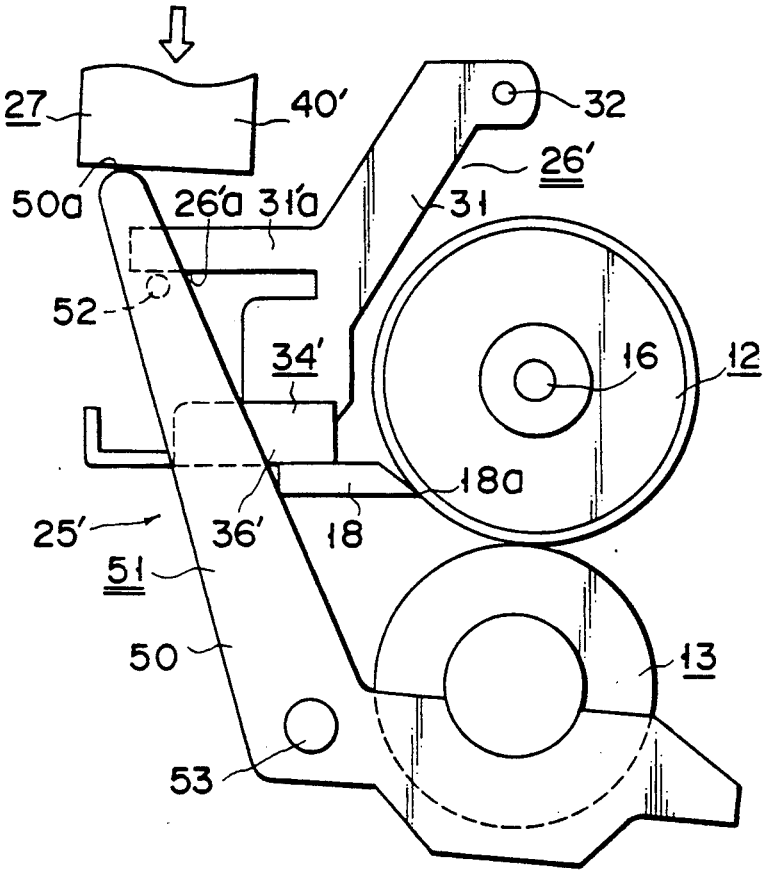
FIG. 7 is a view illustrating how the releasing claw contacts the fixing rollers when the upper unit is closed in an electronic copying apparatus according to an another embodiment of the present invention.

When the upper unit 1*a* is closed, the pressing roller 13 is in rolling contact with the heating roller 12, as is shown in FIG. 7. At the time, the tip ends 18*a* of the sheet-releasing claws 18 are in contact with the surface of the heating roller 12.

Figure 8:
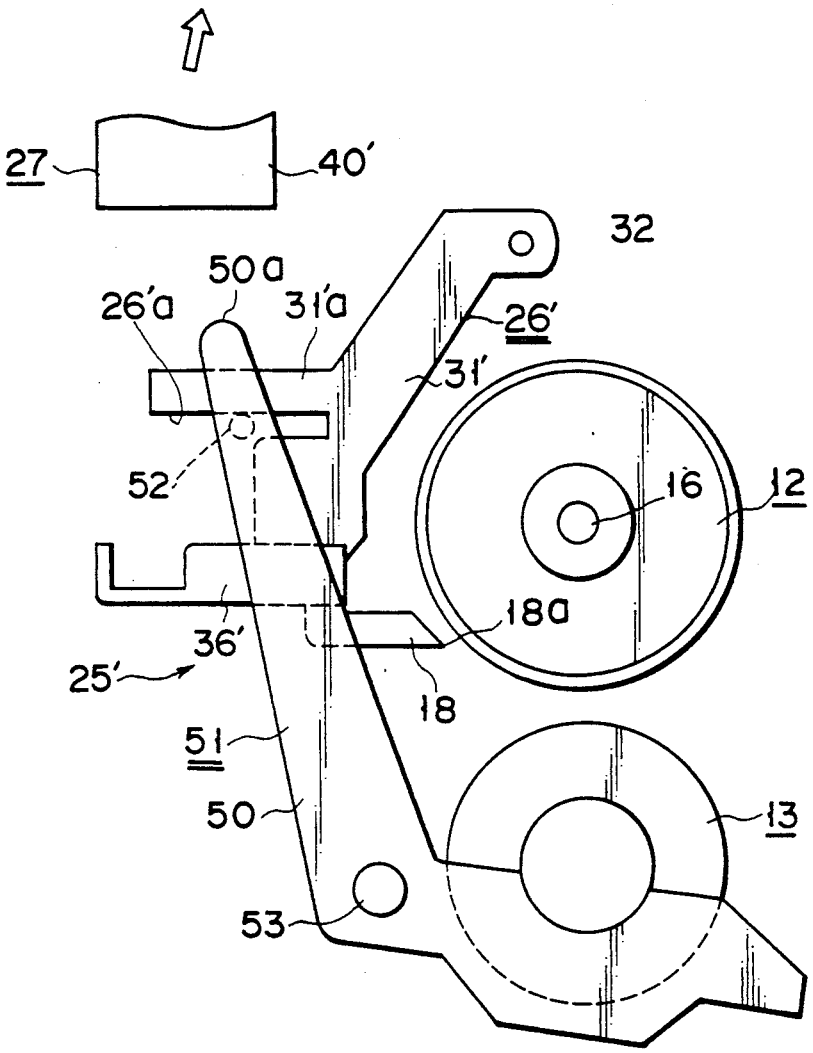
FIG. 8 is a view showing how the releasing claw is separated from the fixing rollers when the upper unit is opened in the apparatus shown in FIG. 7.

When the upper unit la is open, the pressing roller 13 is kept separated from the heating roller 12, as is shown in FIG. 8. At the time, the tip ends 18*a* of the releasing claws 18 are kept separated from the surface of the heating roller 12.

According to the second embodiment, a gap is defined between the pressing roller 13 and the heating roller 12 when the upper unit 1*a* is open. Therefore, it is easy to remove sheets P if these sheets P cause an abnormal transfer state and stay in the sheet transfer path.

The present invention is not limited to the embodiments mentioned above. For example, the claw contact-/separation device may have any structure, as long as it allows the sheet-releasing claws 18 to separate from the heating roller 12 in association with the opening operation of the upper unit la and to contact the heating roller 12 in association with the closing operation of the upper unit 1*a*. Further, not only the heating roller 12 but also the pressing roller 13 may have a heating lamp.

In addition to the above, the present invention may be modified in various manners without departing from the spirit and scope of the invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept a defined by the appended claims and their equivalents.

What is claimed is:

1. An apparatus for fixing an image to an image recording medium, comprising:

first and second fixing rollers in rolling contact with each other, for fixing the image onto the image recording medium passing through the first and second fixing rollers;

means, having a section contacting the first fixing roller, for guiding the recording medium carried along the first roller in a direction to separate the recording medium from the first fixing roller;

means for rotatably supporting the guiding means;

a separable housing including first and second units which may be opened or closed with reference to each other, said first and second fixing rollers being received in said housing; and means for causing the guiding means to rotate along the supporting means to release the contact of the contact section and separate the recording medium in contact with the contact section from the first fixing roller in the separating direction in association with the opening operation of the first unit.

2. An apparatus according to claim 1, wherein said first and second units are upper and lower units, respectively.

3. An apparatus according to claim 1, wherein said first fixing roller is a heating roller incorporating a heating source therein; and said second fixing roller is a pressing roller which is pressed against the heating roller.

4. An apparatus according to claim 1, wherein said separation means includes a claw support mechanism for movably supporting the releasing claw, and pushing means for moving the releasing claw with reference to the first fixing roller by utilization of a force applied to a force-receiving portion of the claw support mechanism.

5. An apparatus according to claim 4, wherein said claw support mechanism includes a pair of support arms which are rotatable around a first rotation-permitting support, an arm coupling member for coupling the support arms together, and a claw holding unit which is rotatable around a second rotation-permitting support provided for the arm coupling member.

6. An apparatus according to claim 5, wherein said claw holding unit includes a base member which is supported in such a manner as to be rotatable around a shaft projected from a bracket coupled to the arm coupling member, and releasing claws attached to the base member.

7. An apparatus according to claim 6, wherein said releasing claws are arranged at predetermined intervals in a longitudinal direction of the base member.

8. An apparatus according to claim 7, wherein said releasing claws are supported in such a manner as to be rotatable around shafts projected from brackets coupled to the base member, and said releasing claws are urged by a spring member to rotate around the shafts in such a direction that distal ends of the releasing claws contact the fixing rollers.

9. An apparatus according to claim 8, wherein said base member includes a synthetic resin block serving as a force-receiving portion which is exerted with a force when the first unit is closed.

10. An apparatus for fixing an image to an image recording medium, comprising:

first and second fixing rollers, in rolling contact with each other, for fixing the image on the image recording medium passing through the first and second fixing rollers;

means, having a section contacting the first fixing roller, for guiding the recording medium carried along the first fixing means in a direction to separate the recording medium from the first fixing roller;

means for rotatably supporting the guiding means;

a separable housing including first and second units which may be opened or closed with reference to each other, said first and second fixing rollers being received in said housing; and means for urging the second fixing roller into contact with the first fixing roller in association with the closing operation of the first unit and separating the second fixing roller from the first fixing roller in association with the opening operation of the first unit;

means for causing the guiding means to rotate around the supporting means to release the contact of the contact section and separate the recording medium in contact with the contact section from the first fixing rollers in the separating direction in association with the opening operation of the first unit; and means for bringing the guiding means into contact with the fixing rollers in association with the closing operation of the first unit.

11. An apparatus according to claim 10, wherein said first and second units are upper and lower units, respectively.

12. An apparatus according to claim 10, wherein said first fixing roller is a heating roller incorporating a heating source therein, and said second fixing roller is a pressing roller which is pressed against the heating roller.

13. An apparatus according to claim 10, wherein said separation means includes a claw support mechanism for movably supporting the releasing claw, and a raising mechanism for moving the releasing claw with reference to the first fixing roller by utilization of a raising force applied to a raising force-receiving portion of the claw support mechanism.

14. An apparatus according to claim 13, wherein said claw support mechanism includes a pair of support arms which are rotatable around a rotation-permitting support, and a claw holding unit fixed to the lower ends of the support arms.

15. An apparatus according to claim 14, wherein said claw holding unit includes a base member fixed to the support arms, and releasing claws arranged on the base member.

16. An apparatus according to claim 15, wherein said releasing claws are arranged at predetermined intervals in the longitudinal direction of the base member.

17. An apparatus according to claim 16, wherein said releasing claws are supported in such a manner as to be rotatable around shafts projected from brackets coupled to the base member, and said releasing claws being urged by a spring member, to rotate around the shafts in such a direction the distal ends of the releasing claws contact the fixing rollers.

18. An apparatus according to claim 14, wherein said support arms abut a pin projected from the support lever, whereby said support arms are positioned.

19. An apparatus according to claim 18, wherein said support lever has an upper end portion serving as a lowering force-receiving portion which receives a lowering force when the first unit is closed.

20. An image forming apparatus comprising means for forming an image on an image recording medium;

means for fixing the image formed by said forming mean on the image recording medium, said fixing means including first and second fixing rollers in rolling contact with each other;

means for releasing the recording medium from the fixing rollers;

a housing including first and second units which may be opened or closed with reference to each other, said fixing means being received in said housing; and means for separating the releasing means from the fixing rollers in association with the opening operation of the first unit, said separating means having at least two rotation-permitting supports.

21. An apparatus according to claim 20, wherein said first and second units are upper and lower units, respectively.

22. An apparatus according to claim 20, wherein said first fixing roller is a heating roller incorporating a heating source therein, and said second fixing roller is a pressing roller which is pressed against the heating roller.

23. An apparatus according to claim 20, wherein said separation means includes a claw support mechanism for movably supporting a releasing claw, and a raising mechanism for moving the releasing claw with reference to the first fixing roller by utilization of a raising force applied to a raising force-receiving portion of the claw support mechanism.

24. An apparatus according to claim 23, wherein said claw support mechanism includes a pair of support arms which are rotatable around a rotation-permitting support, and a claw holding unit fixed to the lower ends of the support arms.

25. An apparatus according to claim 24, wherein said claw holding unit includes a base member fixed to the support arms, and releasing claws arranged on the base member.

26. An apparatus according to claim 25, wherein said releasing claws are arranged at predetermined intervals in the longitudinal direction of the base member.

27. An apparatus according to claim 26, wherein said releasing claws are supported in such a manner as to be rotatable around shafts projected from brackets coupled to the base member, and said releasing claws are urged by a spring member to rotate around the shafts in such a direction that distal ends of the releasing claws contact the fixing rollers.

28. An apparatus according to claim 24, wherein said support arms abut a pin projected from the support lever, whereby said support arms are positioned.

29. An apparatus according to claim 28, wherein said support lever has an upper end portion serving as a lowering force-receiving portion which receives a lowering force when the first unit is closed.

* * * * *